United States Patent [19]

Sato

[11] Patent Number: 4,483,013

[45] Date of Patent: Nov. 13, 1984

[54] X-RAY RADIATION CONTROL METHOD AND APPARATUS

[75] Inventor: Hideki Sato, Ootawara, Japan

[73] Assignee: Tokyo Shibaura Denki Kabushiki Kaisha, Kawasaki, Japan

[21] Appl. No.: 440,589

[22] Filed: Nov. 10, 1982

[30] Foreign Application Priority Data

Nov. 12, 1981 [JP] Japan ..... 56-181458

[51] Int. Cl.[3] ..... H05G 1/30; H05G 1/64

[52] U.S. Cl. ..... 378/112

[58] Field of Search ..... 378/112, 111

[56] References Cited

U.S. PATENT DOCUMENTS 2,730,628 1/1956 Quittner ..... 378/112

FOREIGN PATENT DOCUMENTS 54-102994 8/1979 Japan .

*Primary Examiner*—Alfred E. Smith
*Assistant Examiner*—T. N. Grigsby
*Attorney, Agent, or Firm*—Cushman, Darby & Cushman

[57] ABSTRACT

An X-ray radiation control apparatus comprises an X-ray tube, tetrodes each connected between the anode and the cathode of the X-ray tube, and tetrode controlling circuits connected thereto. Each of the tetrode controlling circuits controls the anode voltage drop of the respective tetrode for stabilizing a high-tension DC voltage to be applied to the X-ray tube as well as removing ripple components therefrom. Each tetrode controlling circuit is constituted by a first high-voltage transistor for producing a first grid bias controlling voltage for stabilizing the high-tension DC voltage and a second high frequency transistor for producing a second grid bias controlling voltage for absorbing the ripple components contained in the high-tension DC voltage.

27 Claims, 2 Drawing Figures

X-RAY RADIATION CONTROL METHOD AND APPARATUS

BACKGROUND OF THE INVENTION

This invention generally relates to an X-ray radiation (or dose) control apparatus, and more particularly to an X-ray radiation apparatus which can stabilize X-ray radiation (or dose) from an X-ray tube by filtering the ripple components from the high voltage applied between the anode and the cathode of the X-ray tube.

X-ray radiation stability is one of the most significant factors for an X-ray diagnostic apparatus, because it largely determines the accuracy of the diagnostic information obtained thereby. In order to stabilize X-ray radiation a stable voltage is required to be applied between the anode and the cathode of the X-ray tube, and the heating voltage for the filament of the X-ray tube has to be kept constant.

A method of stabilizing the voltage to be applied to the X-ray tube is known. This method consists of using an electron tube such as a tetrode connected between a high voltage source and an X-ray tube. The tetrode can remove ripple components due to its internal voltage drop from a high DC voltage produced by raising the voltage of a three-phase power source and rectifying it in the full-wave rectification, thereby applying a substantially perfect DC voltage between the anode and the cathode of the X-ray tube. The principle of the method is based on the dynamic plate (anode) resistance which plays an important part in the calculation of a tube amplifier gain, where the tube is often treated as a variable resistor.

Japanese patent application No. 53-9773 filed by Tokyo Shibaura Denki K.K., Japan [Japanese Unexamined (Kokai) patent application No. 54-102994] discloses a method of controlling the voltages to be applied to an X-ray tube by utilizing the internal voltage drop of a tetrode which is series-connected to the anode and the cathode of the X-ray tube.

A typically known X-ray control circuit based on the above-mentioned principle is shown in FIG. 1. The circuit comprises a circuit breaker 1, a high voltage transformer 2, and a full-wave rectifier bridge circuit 3. The circuit breaker 1 is connected between a three-phase power source (not shown) and the primary winding of the Delta connected high voltage transformer 2. The secondary windings of the transformer 2, are Delta-and Star-connected to the input of the full-wave rectifier bridge circuit 3. A first tetrode 4 is connected between the anode of an X-ray tube 6 and the output of the rectifier bridge circuit 3, and a second tetrode 5 is connected between the cathode of the X-ray tube 5 and the output of the rectifier bridge circuit 3, whereby the DC voltages obtained from the bridge circuit 3 are lowered by the tetrodes 4 and 5 to predetermined supply voltages (hereinafter called "an X-ray tube supply voltage"). This is accomplished by means of the anode voltage drops of the tetrodes 4 and 5 so as to generate X-rays for diagnostic purposes. The X-ray control circuit further comprises two tetrode control circuits 7 and 8 which are connected to the anode and the cathode of the X-ray tube 6 for controlling the tetrodes 4 and 5, respectively. More specifically, either tetrode control circuit changes the grid bias voltage of the corresponding tetrode, to thereby vary the anode voltage drop of the tetrode. Two high-tension bleeder resistors 10 and 11 are connected at one end to each other (ground) and at the other end to the anode and the cathode of the X-ray tube 6, respectively. A comparator amplifier 12 is connected to receive a preset tetrode control signal 9 at one input terminal and a voltage signal developed by the resistor 10 at the other terminal. A comparator amplifier 13 is also connected to receive the same preset tetrode control signal at one input terminal and a voltage signal developed by the resistor 11 at the other terminal. Each comparator amplifier compares the control signal 9 with the voltage signal and then amplifies the resultant signal. An output signal from the comparator amplifier 12 is supplied to the tetrode control circuit 7 through a high-tension isolation circuit 15. Similarly, an output signal from the comparator amplifier 13 is supplied to the tetrode control circuit 8 through a high-tension isolation circuit 14. A stabilized high-tension voltage can thus be applied to the X-ray tube.

The operation of the tetrode control circuit just described may be summarized as follows. In order to obtain the preset X-ray tube apply voltage, it is necessary to adjust the above-mentioned anode voltage drop of the tetrodes 4 and 5. To this end, the preset tetrode control signal 9 and the voltage signal developed by the bleeder resistors either 10 or 11, are supplied to the respective comparator amplifier 12 or 13 so as to produce the tetrode control signal for the tetrode control circuit 7 or 8 respectively. As a result, the. higher DC voltage applied to the X-ray tube can be stabilized to the preset X-ray tube supply voltage.

Utilizing the anode voltage drops of the tetrodes 4 and 5, each tetrode control circuit is used not only to control the high-tension voltage to be applied to the X-ray tube 6, but also to remove ripple components from the three-phase DC voltage. It must therefore have an extremely high response. The response to the tetrode control circuit directly depends on the frequency characteristics of the semiconductor voltage controlling elements e.g. transistors used in this circuit.

Generally, in order to stabilize the X-ray tube supply voltage, the required voltage variation of the tetrode anode voltage drop is more than 500 V. On the other hand, in order to filter the ripple components contained in the X-ray tube supply voltage, the above-mentioned required variation is on the order of only several tens of volts, but its required response characteristic is considerably higher than that of the first-mentioned case.

Since generally the frequency characteristics of the commercially available high-voltage withstanding transistors present deterioration in the higher frequency range i.e., $f_T$ being a low value, such a transistor can not respond to the higher frequency variation of a signal sufficiently.

SUMMARY OF THE INVENTION

It is therefore an object of the present invention to provide an X-ray radiation control apparatus provided with a tetrode control circuit which can follow the high speed variation of a signal of which the voltage variation is more than 500 V.

An X-ray radiation control apparatus according to the invention comprises tetrode control circuits each including a high-tension-withstanding transistor whose base receives an X-ray tube apply voltage control signal and whose output signal is varied according to the level of the control signal, to thereby vary the grid bias of the tetrode, and subsequently control the X-ray tube supply voltage. Each tetrode control circuit further includes an inverting amplifier for inverting the X-ray tube supply voltage control signal and a high-speed transistor for varying the low voltage according to an output signal from the inverting amplifier. An output signal from the high-speed transistor is supplied to the grid of the tetrode, to thereby remove the ripple components of the X-ray supply voltage. The term "high-speed transistor" means a so-called "high-frequency transistor" whose cut-off frequency is rather high.

According to the present invention, the tetrode control circuits can respond not only to a high-tension DC voltage but also to high-frequency ripple components of the lower DC voltages, utilizing the anode voltage drop of the tetrodes. The high-tension DC voltage to be applied to the X-ray tube can thus be stabilized. Further, the tetrode control circuits may each include a transistor for controlling the grid bias of the tetrode. The tetrode control circuits therefore provide an improved response and an improved reliability.

BRIEF DESCRIPTION OF THE DRAWINGS

The invention is best understood by reference to the accompanying drawings, of which.

DETAILED DESCRIPTION OF THE PREFERRED EMBODIMENTS

Figure 1:
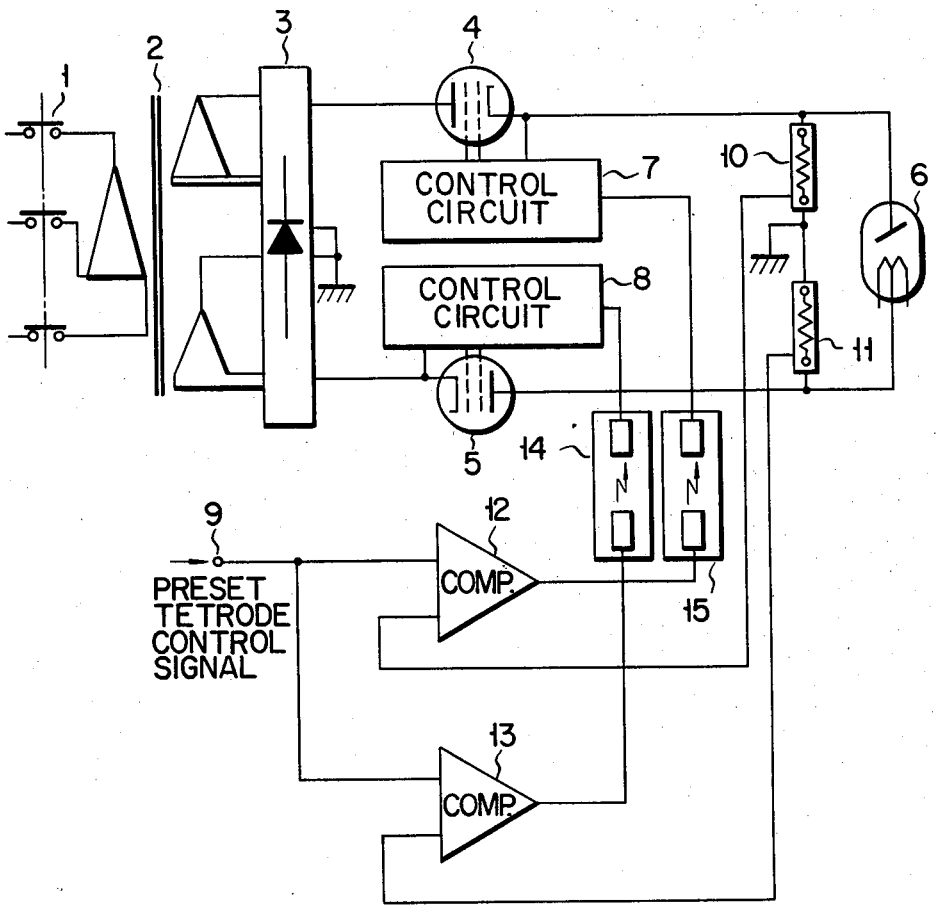
FIG. 1 is a circuit diagram schematically illustrating a conventional X-ray control circuit.
Figure 2:
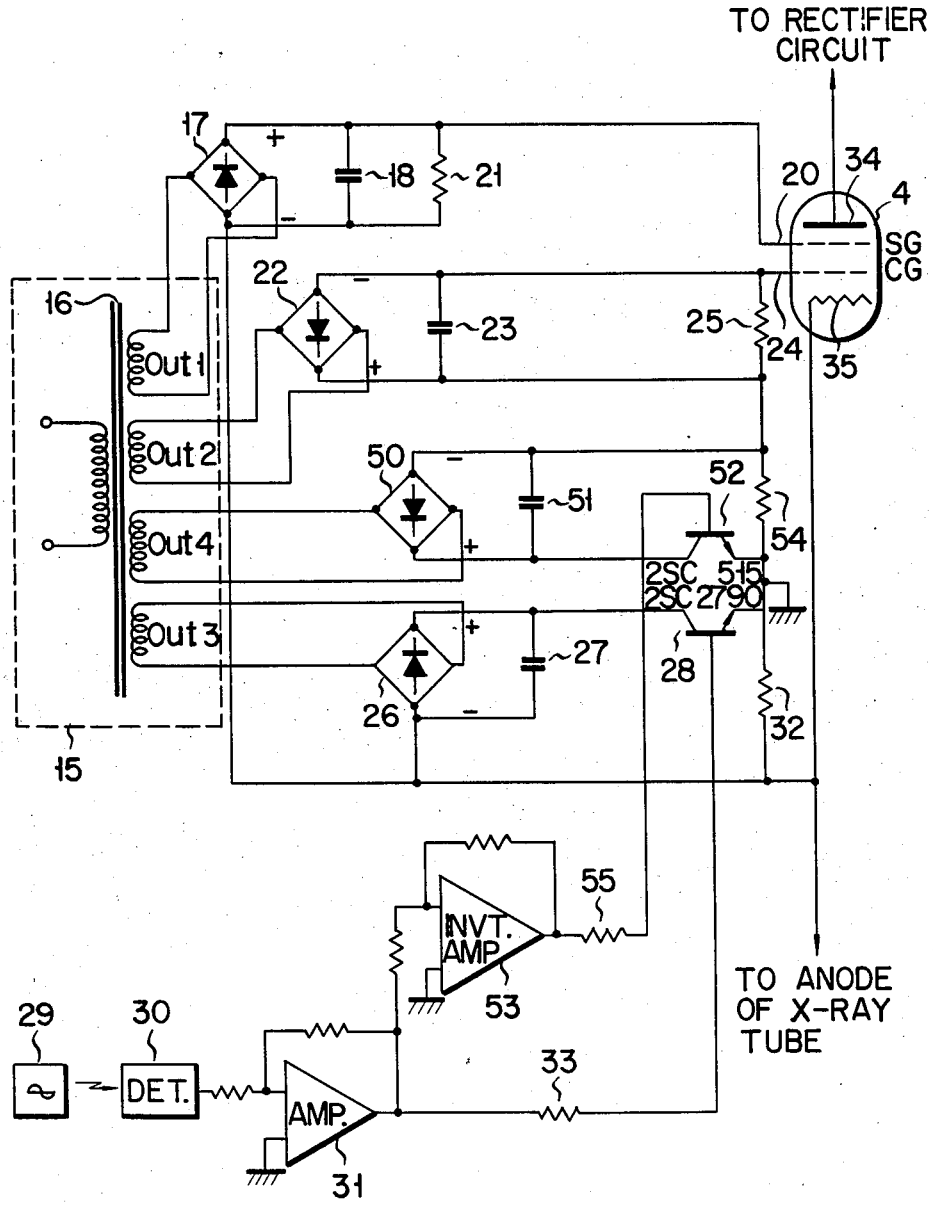
FIG. 2 is a circuit diagram schematically showing one embodiment of a tetrode control circuit used in an X-ray radiation control apparatus according to the present invention.

FIG. 2 shows one of the tetrode control circuits used in an X-ray radiation control apparatus of the invention, and a high-voltage isolation circuit which cooperates with the tetrode control circuit. In FIG. 2, the part surrounded by a broken line corresponds to the high-voltage isolation circuit 15 shown in FIG. 1, and the remaining part corresponds to the tetrode control circuit 7 shown in FIG. 1. Though not shown, other circuits which correspond to the tetrode control circuit 8 and the high-voltage isolation circuit 14, both shown in FIG. 1, are provided.

The basic operation of this tetrode control circuit 7 shown in FIG. 2 is designed to vary the DC voltage of about 500 V according to the tetrode control signal supplied from the high-voltage isolation circuits and to remove the ripple components of the high-tension DC voltage to be applied to the X-ray tube. This is done by controlling the tetrode supply voltage by using a voltage controlling element such as a transistor. The tetrode control circuit 7 has transistors 28 and 52 which are used as voltage control elements for controlling the voltage applied to the grid of the tetrode 4.

As shown in FIG. 2, the high-voltage isolation circuit 15 is mainly constituted by a high-voltage isolation transformer 16 which supplies the necessary power to given components of the tetrode control circuit 7. It should be noted that though a photocoupler is shown as the isolation circuit in FIG. 1, it is omitted in this embodiment. A first output Out 1 from the isolation transformer 16 undergoes full-wave rectification at a diode bridge 17. An output signal from the diode bridge 17 is then smoothed by a smoothing capacitor 18 and thereafter supplied to the screen grid 20 (hereinafter called "SG") of the tetrode 4. A load resistor 21 is connected in parallel to the smoothing capacitor 20. A second output Out 2 from the isolation transformer 16 undergoes full-wave rectification at a diode bridge 22. An output signal from the diode bridge 22 is then smoothed by a smoothing capacitor 23 and thereafter supplied to the control grid 24 (hereinafter called "CG") of the tetrode 4. A load resistor 25 is connected in parallel to the smoothing capacitor 23. A third output Out 3, having a value of 600 to 800 volts, from the isolation transformer 16, undergoes full-wave rectification at a diode bridge 26. An output signal from the diode bridge 26 is then smoothed by a smoothing capacitor 27 and thereafter supplied to the collector of a transistor 28 which functions as a voltage controlling element. This bipolar transistor 28 may comprise a high-voltage withstanding transistor, such as Toshiba's transistor 2SC 2790 which can be operated under several hundreds of volts.

A signal level detecting circuit 30 is provided for detecting the level of the tetrode control signal 29 from a comparator amplifier (not shown) which corresponds to the comparator amplifier 12 shown in FIG. 1. An output signal from the detecting circuit 30 is amplified by an amplifier 31 and then supplied to the base of the transistor 28. Therefore, the transistor 28 can control the third output Out 3 according to the level of the signal from the amplifier 31. The output current from the transistor 28 is supplied to the junction of the resistor 32 on the one hand and transistors 52 and a resistor 54 on the other hand. Accordingly, a change of the output current of the transistor 28 may cause the voltage applied on CG 24 of the tetrode 4 to be changed. The resistor 32 is a load resistor of 11.72 KΩ provided for the third output Out 3 of the high-voltage isolation transformer 16. A resistor 33 is connected between the output of the amplifier 31 and the base of the transistor 28 for limiting the input current of the transistor 28.

Therefore, the anode current flowing from the anode 34 of the tetrode 4 to the cathode 35 is controlled by the tetrode control signal 29, whereby the voltage applied on the tetrode 4, i.e. its anode voltage drop, can be varied.

The last output, or the fourth output Out 4, having a value of 40 to 60 volts, of the high-voltage isolation transformer 16, undergoes full-wave rectification at a diode bridge 50. An output signal from the diode bridge 50 is smoothed by a smoothing capacitor 51 and supplied to the collector of a transistor 52 having a high frequency response. This bipolar transistor 52 may comprise a high frequency transistor, such as Toshiba's transistor 2SC 515 which can respond to a high-frequency signal, i.e. one having a high-speed variation of the ripple components.

An inverting amplifier 53 is provided for inverting and amplifying an output signal from the amplifier 31. An output signal from the inverting amplifier 52 is supplied as the tetrode control signal to the base of the transistor 52. When the transistor 52 supplies an output current, a potential difference is produced across the load resistor 54 of 22 KΩ. Accordingly, a change of the output current of the transistor 52 may cause the voltage across the resistor 54 to be changed. Similarly a resistor 55 is connected between the output of the inverting amplifier 53 and the base of the transistor 52 for limiting the input current of the transistor 52. The resistor 55 therefore performs the same function as the resistor 33.

The tetrode control circuit shown in FIG. 2 operates in the following manner. Firstly, the tetrode control signal 29 is supplied to the base of the transistor 28 through the signal level detecting circuit 30, the amplifier 31 and the current limiting resistor 33. The voltage across the load resistor 32 is thus changed. Secondly, the output signal from the amplifier 31 is inverted by the inverting amplifier 53 and applied through the current limiting resistor 55 to the base of the transistor 52. The output signal from the transistor 52 is supplied to the resistor 54 which is connected between the resistors 25 and 32. Hence, when the voltage across the resistor 32 becomes high, the voltage across the resistor 54 becomes low, and vice versa. This is because the tetrode control signal 29 is amplified by the amplifier 31 and supplied to the base of the high-voltage withstanding transistor 28, and the same control signal 29 is inverted by the inverting amplifier 53 and supplied to the base of the RF transistor 52.

Moreover, since the resistors 25, 54 and 32 are connected in series, the voltage applied on the CG 24 of the tetrode 4 changes according to the variation of the level of the tetrode control signal 29. In addition, the variation of the output voltage of the RF transistor 52 can control the tetrode control circuit in such a way that it responds to the signal 29 quickly enough to remove the ripple components from the X-ray tube supply voltage.

It should be noted that the second output Out 2 of the transformer 16, which includes the resistor 25 connected to the CG 24 of the tetrode 4, is to apply a fixed grid bias on the tetrode 4 so as to prevent an accidental positive biasing operation.

Now the operation of the tetrode control circuit may be summarized as follows. The high voltage component for controlling the anode voltage drop of the tetrode 4 is controlled by the circuit for supplying the third output Out 3, which includes the high-voltage withstanding transistor 28. The small and high frequency voltage components for filtering the ripple components contained in the voltage to be applied to the anode and the cathode of the X-ray tube are controlled by the circuit for supplying the fourth output Out 4, which includes the high-frequency transistor 52. The output voltages of these two circuits are series-combined for controlling the voltage to be applied on the CG 24 of the tetrode 4. The tetrode control circuit 7 can therefore stabilize the high-tension voltage to be applied to the X-ray tube, which contains no ripple components. Consequently, both the anode and cathode supply voltages of the X-ray tube can be stabilized by the tetrode circuit 7 shown in FIG. 2 and the other tetrode circuit 8 (not detailed shown), whereby stabilized X-ray radiation can be achieved from the X-ray tube 6.

The invention is not restricted to the embodiment described above. Various modifications may be realized without departing from the technical scope and spirit of the invention. For example, unipolar transistors may be employed in place of the bipolar transistors 28 and 52. Further, instead of two voltage controlling elements, i.e. the transistors 28 and 52, a single voltage controlling element may be used which can be operated under higher voltage and in a higher frequency range. Moreover, the circuit for supplying the second output Out 2 (i.e. a biasing voltage) may be omitted if no positive biasing of the tetrode 4 takes place. It is obvious that instead of the common input circuit (29, 30), it is possible alternatively to employ two separate input circuits of which the signal polarities are different (reverse) from each other.

What is claimed is:

1. A method for regulating the voltage supply to an Xray tube, comprising the steps of:

(1) applying a high-voltage DC supply voltage to voltage controlled resistance means, responsive to signals applied to a control input, for producing a regulated supply voltage;

(2) applying said regulated supply voltage to said X-ray tube;

(3) producing a first control signal in response to low frequency variations in an input control signal;

(4) producing a second control signal in response to high frequency variations in said input control signal; and (5) applying said first and second control signals to said control input of said voltage controlled resistance means to control said regulation of said supply voltage.

2. A method as in claim 1 further including the step of inverting said input control signal, one of said first and second control signals being produced in response to said inverted input control signal, the other of said first and second control signals being produced in response to the non-inverted control signal.

3. A method as in claim 2 wherein:

said method further includes the step of producing a difference signal proportional to the difference between said first and second control signals, said applying step (5) applying said difference signal to said control input; and said producing step (3) produces said first control signal in opposite plurality to said second control signal producing step (4) so that the amplitude of said difference signal is proportional to the amplitude of said input control signal.

4. A method as in claim 1 wherein:

said producing step (3) includes the steps of:

producing a first control voltage; and selectively passing said first control voltage in response to said low frequency variations in said input control signal; and said producing step (4) includes the steps of:

producing a second control voltage; and selectively passing said second control voltage in response to said high-frequency variations in said input control signal.

5. A method as in claim 1 wherein:

said method further includes the steps of:

sampling said regulated supply voltage;

comparing said sampled regulated supply voltage with reference signal; and inverting the results of said comparison; and one of said first and second control signals are produced in response to said inverted results, the other of said first and second control signals being produced in response to the non-inverted results.

6. An X-ray radiation control apparatus comprising:

an X-ray tube;

a rectified high-tension DC voltage source;

at least one tetrode connected between said X-ray tube and said rectified high-tension DC voltage source for producing a stable high-tension DC X-ray tube voltage from a voltage produced by said rectified high-tension DC voltage source and for removing ripple components contained in said voltage produced by said source by utilizing the effect of an anode voltage drop, said tetrode including a control grid;

first voltage controlling means, including a first power source and a high-tension withstanding semiconductor element, for producing a first grid bias controlling voltage;

second voltage controlling means, including a second power source and a high frequency semiconductor element, for producing a second grid bias controlling voltage; and means for applying a low voltage tetrode control signal to said high-tension withstanding semiconductor element and also to said high frequency semiconductor element, said first and second grid bias controlling voltages being series-coupled to said control grid so as to control the anode voltage drop of said tetrode.

7. An X-ray radiation control apparatus as claimed in claim 6, wherein said applying means includes inverting means for inverting said low voltage tetrode control signal, said inverted control signal applied to said high frequency semiconductor element, said low voltage tetrode control signal applied to said high-tension withstanding semiconductor element.

8. An X-ray radiation control apparatus as claimed in claim 6, further comprising fixed DC voltage biasing means for producing a third grid bias controlling voltage from a third power source and applying the same to the control grid of said tetrode in a series combination with said first and second grid bias controlling voltages

9. An apparatus for producing X-ray radiation, said apparatus adapted to receive an input control signal, said apparatus including:

X-ray generating means for producing said radiation, said generating means responsive to a regulated high-voltage DC supply voltage;

voltage source means for producing a high-voltage DC voltage; and means for regulating said high-voltage DC voltage produced by said voltage source means to produce said regulated voltage, including:

first control voltage producing means, responsive to low frequency variations in said input control signal, for producing a first control voltage;

second control voltage producing means, responsive to high-frequency variations in said input control signal, for producing a second control voltage; and at least one voltage controlled resistance means, connected between said voltage source means and said Xray generating means, for changing resistance in response to said first and second control voltages to regulate said high-voltage DC voltage produced by said voltage source means.

10. An apparatus as in claim 9 wherein said regulating means further includes inverting means for inverting said input control signal, said first control voltage producing means is responsive to the non-inverted input control signal, and said second control voltage producing means is responsive to said inverted input control signal.

11. An apparatus as in claim 10 wherein said regulating means further includes signal differential means for producing a difference signal proportion to the difference between said first and second control voltages, said voltage-controlled resistance means being responsive to said difference signal, the voltage produced by said first control voltage means being opposite in polarity to the voltage produced by said second control voltage means such that the amplitude of said difference signal is directly proportional to the amplitude of said input control signal.

12. An apparatus as in claim 9 wherein:

said first control voltage producing means includes:

a first control voltage source; and high voltage semiconductor element means, responsive to said low frequency variations in said control signal, for selectively passing a voltage produced by said first control voltage source; and said second control voltage producing means includes:

a second control voltage source; and high-frequency semiconductor element means, responsive to said high frequency variations in said input control signal, for selectively passing a voltage produced by said second control voltage source.

13. An apparatus as in claim 12 wherein:

said regulating means further includes an isolation transformer, said isolation transformer including a primary winding and at least first and second secondary windings, said first control voltage source responsive to a voltage produced by said first secondary winding, said second control voltage source responsive to a voltage produced by said second secondary winding, said primary winding adapted to be coupled to said regulated high-voltage DC supply voltage.

14. An apparatus as in claim 9 wherein said voltage-controlled resistance means comprises a tetrode including control grid means, responsive to said first and second control voltages, for changing the voltage drop across said tetrode.

15. An apparatus as in claim 14 wherein said regulating means further comprises fixed DC biasing means for applying a negative fixed DC bias voltage to said control grid together with said first and second control voltages.

16. An apparatus as in claim 9 further comprising means for producing said input control signal, including:

sampling means for sampling said regulated supply voltage; and differential amplifying means for producing said input control signal, said input control signal proportional to the difference between said sample voltage and a reference level.

17. An apparatus as in claim 16 wherein said sampling means includes an isolation transformer.

18. An X-ray radiation control apparatus comprising an X-ray tube;

a rectified high-tension DC voltage source;

at least one tetrode connected between said X-ray tube and said rectified high-tension DC voltage source for stabilizing a high-tension DC X-ray tube supply voltage produced by said rectified high-tension DC voltage source and for removing ripple components contained therein by utilizing the effect of its anode voltage drop;

control grid biasing means, coupled to the control grid of said tetrode and including a semiconductor voltage controlling means connected to receive a low voltage tetrode control signal, for controlling said anode voltage drop of the tetrode so as to obtain the stabilized high-tension DC voltage without the ripple components to be applied to said X-ray tube; and inverting means connected to receive said low voltage tetrode control signal, said semiconductor voltage controlling means including a first semiconductor voltage controlling element connected to receive said low voltage control signal so as to produce a first grid bias controlling voltage for stabilizing the high-tension DC voltage to be applied to said X-ray tube and a second semiconductor voltage controlling element connected to receive a low voltage tetrode control signal of reversed polarity with respect to said low voltage tetrode control signal from said inverting means so as to produce a second grid bias controlling voltage for removing the ripple components contained in said high-tension DC voltage to be applied to said X-ray tube, said first and second grid bias controlling voltages being series-coupled to control the anode voltage drop of said tetrode.

19. An X-ray radiation control apparatus according to claim 18, wherein said first and second semiconductor voltage controlling elements comprise bipolar transistors.

20. An X-ray radiation control apparatus according to claim 18, wherein said first and second semiconductor voltage controlling elements comprise unipolar transistors.

21. An X-ray radiation control apparatus as claimed in claim 18, further comprising fixed DC biasing means for producing a third grid bias controlling voltage from a third power source and applying the same to the control grid of said tetrode in a series combination with said first and second grid bias controlling voltages.

22. An X-ray radiation control apparatus as claimed in claim 18, wherein said semiconductor elements comprise bipolar transistors.

23. An X-ray radiation control apparatus as claimed in claim 18, wherein said semiconductor elements comprise unipolar transistors.

24. An X-ray radiation control apparatus according to claim 18, further comprising fixed DC biasing means for producing and applying a third grid bias controlling voltage to the control grid of said tetrode in series combination with said first and second grid bias controlling voltages.

25. An X-ray radiation control apparatus according to claim 24, which further comprises two power sources connected to said first and second semiconductor voltage controlling elements, respectively, and in which said fixed DC biasing means and said two power sources are formed of a common high-voltage isolation transformer.

26. An X-ray radiation control apparatus as claimed in claim 25, wherein said first and second power sources of said first and second voltage controlling elements and said third power source of said fixed DC biasing means each include respective windings of a common high-tension isolated transformer.

27. An X-ray radiation control apparatus as claimed in claim 24, wherein said first and second power sources of said first and second voltage controlling means and said third power source of said fixed DC biasing means each include respective windings of a common high-tension isolation transformer.

* * * * *